US009160051B2

(12) United States Patent
Sun

(10) Patent No.: US 9,160,051 B2
(45) Date of Patent: Oct. 13, 2015

(54) RADIO FREQUENCY COMBINER/DIVIDER

(71) Applicant: INTAI TECHNOLOGY CORP., Taichung (TW)

(72) Inventor: Richard Loon Sun, Taichung (TW)

(73) Assignee: INTAI TECHNOLOGY CORP., Taichung (TW)

( * ) Notice: Subject to any disclaimer, the term of this patent is extended or adjusted under 35 U.S.C. 154(b) by 247 days.

(21) Appl. No.: 13/752,115

(22) Filed: Jan. 28, 2013

(65) Prior Publication Data

US 2014/0159830 A1 Jun. 12, 2014

(30) Foreign Application Priority Data

Dec. 11, 2012 (TW) ..... 101146748 A

(51) Int. Cl.
*H01P 5/12* (2006.01)

(52) U.S. Cl.
CPC ..... *H01P 5/12* (2013.01)

(58) Field of Classification Search
CPC ..... H01P 5/12
USPC ..... 333/101, 126–129, 262
See application file for complete search history.

(56) References Cited

U.S. PATENT DOCUMENTS 5,872,491 A * 2/1999 Kim et al. ..... 333/101
6,323,742 B1 11/2001 Ke
7,046,101 B2 5/2006 Mruz et al.

FOREIGN PATENT DOCUMENTS

KR 20040069816 8/2004
KR 20040098857 11/2004

* cited by examiner

*Primary Examiner* — Robert Pascal
*Assistant Examiner* — Kimberly Glenn
(74) *Attorney, Agent, or Firm* — CKC & Partners Co., Ltd.

(57) ABSTRACT

An RF combiner/divider includes an input switch, an output switch, an impedance-matching transmission network for connecting the input switch to the output switch, and a control circuit connected to the input switch and the impedance-matching transmission network. The RF combiner/divider is used for automatic impedance transformation for impedance-matching. The RF combiner/divider is suitable for use in an RF system with a changeable number of combiner/divider branches.

12 Claims, 5 Drawing Sheets

RADIO FREQUENCY COMBINER/DIVIDER

BACKGROUND OF INVENTION

1. Field of Invention

The present invention relates to a radio frequency ("RF") combiner/divider capable of automatic impedance transformation for impedance-matching and, more particularly, to a combiner/divider for use in an RF system that includes a changeable number of combiner/divider branches.

2. Related Prior Art

An RF combiner/divider is used to combine several RF signals into a single output RF signal and divide a single RF signal into several output RF signals. The operation of a divider is opposite to that of a combiner. That is, the structure of a divider can be derived from that of a combiner. The combiner combines several input ports into a single output port while the divider divides a single input port into several output ports.

Impedance transformation networks are used in the combiners or dividers. When the characteristic impedance at the input port is not matched with the output impedance at the output port, an impedance transformation circuit increases or reduces the impedance stage between the input and output ports to match the output impedance with the characteristic impedance as much as possible. Impedance-matching is important to ensure the maximum power transformation and minimum signal distortion and/or reflection between input and output circuits.

Korean Patents KR20040069816 and KR20040098857 both describe Wilkinson combiner/dividers based on the Wilkinson Principle. For convenience of description, only the combiners will be discussed for example. Each input branch includes a quarter-wavelength impedance transformer for impedance transformation to match the output impedance with the input impedance. The impedance transformer of each input branch is given limitation. Hence, when the number of the input branches that are combined is changed, the impedance transformer of each input branch must be changed, and this is impractical because such a structure includes a certain number of transformers based on a certain number of channels to be combined, and the impedances of all of the transformers are based on the number of the channels to be combined. Hence, the Wilkinson combiner/dividers based on the Wilkinson Principle are not suitable for systems that include changeable numbers of combined/divided branches.

U.S. Pat. No. 7,046,101 ("'101") discloses a combiner/divider that is based on the concept of a series/shunt network instead of the Wilkinson Principle. There is disclosed a divider that includes a single-pole N-way RF switch and a switchable impedance-matching network. The switchable impedance-matching network includes N−1 switch-selectable impedance-matching elements. The impedance-matching elements are arranged along a transmission line that includes an input port at an end and a switching connection point at another end. The switching connection point is for selective contact with several output-port reeds. The impedance-matching elements include different impedance-matching lengths. An impedance-matching distance exists between each impedance-matching element and the switching connection point. In operation, when only one output-port reed is in contact with the transmission line, i.e., only one output port is connected to the input port, the load impedance is matched with the source impedance, without having to activate any impedance-matching element. If the number of output ports connected to the input port is changed, the transmission line is connected to an impedance-matching element in a certain position determined by the number of the output ports that are combined, thus initiating an impedance-modulation mechanism for impedance-matching. In practice, the manufacturing and location of the impedance-matching elements require precision.

U.S. Pat. No. 6,323,742 discloses an RF combiner that includes N input channels 126a, 126b, 126c and 126d for receiving input signals. These input channels are electrically connected to an electrical connection point 22 or 132. All of the input signals are combined with one another at the electrical connection point 22 or 132. Then, a quarter-wavelength impedance transformer 34 or 150 transfers the combination of the input signals to an output port. Each input channel includes a grounding switch 26, 28, 30 or 32. There will be high impedance in an input channel if the respective grounding switch is connected to an electrical ground. Hence, the electrical connection point is only connected to an input channel where the grounding switch is open-circuited. An input channel ready for transferring an input signal is defined as an "active input channel." According to the number of the active input channels, a control circuit 116 controls the connection of a first combiner switch 144 and a second combiner switch 154 to the corresponding impedance transformation line to match the output impedance with the input. The grounding switch provides high impedance to interfere with the ability of the input channels to transfer the signals. That is, the input channels are not actually cut off from the electrical connection point although they cannot smoothly transfer the input signals to the electrical connection point. This practice could easily damage the combiner. Moreover, the structure of the first combiner switch 144 and how it works are not described although it is actually part of an impedance transformer.

The present invention is therefore intended to obviate or at least alleviate the problems encountered in prior art.

SUMMARY OF INVENTION

It is an objective of the present invention to provide an inexpensive and efficient RF combiner/divider.

It is another objective of the present invention to provide an RF combiner/divider for use in an RF system that includes a changeable number of combiner/divider branches, wherein the RF combiner/divider is used for automatic impedance transformation for impedance-matching.

To achieve the foregoing objective, the RF combiner includes an input switch, an output switch, an impedance matching transmission network and a control circuit. The input switch includes several input channels for receiving input signals. The output switch includes the same number of input channels as the input channels of the input switch. All of the input channels of the output switch are electrically connected to an output port. The impedance matching transmission network includes switching elements and impedance transmission lines. The number of the switching elements is identical to that of the input channels. The impedance transmission lines are arranged between the switching elements and the input channels of the output switch. The control circuit controls the number of the input channels of the input switch that are electrically connected to a center connection point, and selectively connects an impedance-matched one of the switching elements to the center connection point based on the number.

The control circuit controls the on/off of the input channels via digital inputs at the input channels electrically connected to the input switch.

Other objectives, advantages and features of the present invention will be apparent from the following description referring to the attached drawings.

BRIEF DESCRIPTION OF DRAWINGS

The present invention will be described via detailed illustration of four embodiments referring to the drawings wherein.

DETAILED DESCRIPTION OF EMBODIMENTS

Figure 1:
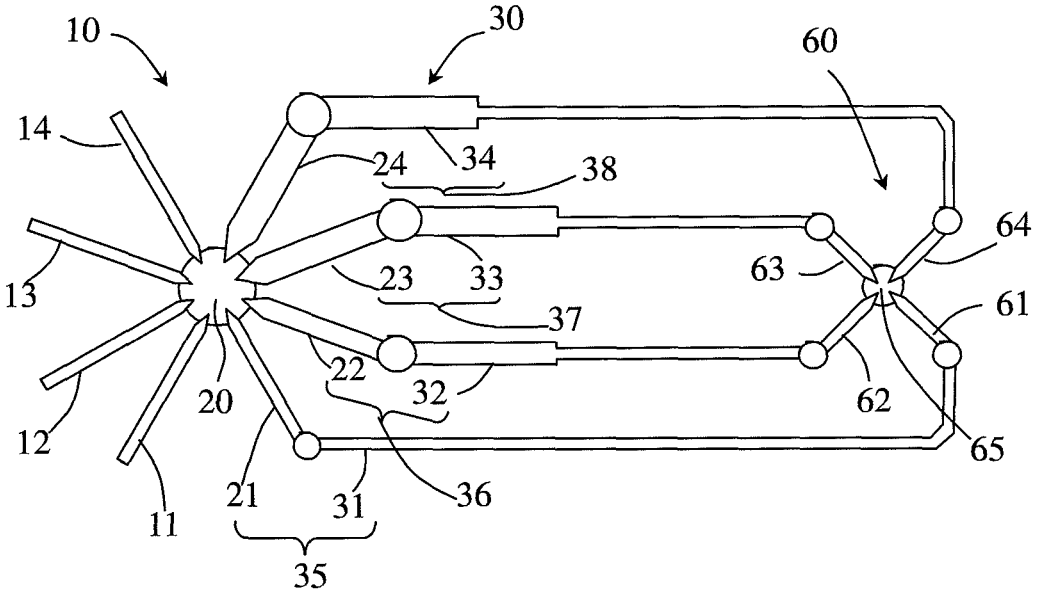
FIG. 1 is a block diagram of an RF combiner/divider according to the first embodiment of the present invention, showing that a quarter of a wavelength of an impedance matching transmission network is longer than the electrical length of the switching elements.

The present invention is related to an RF combiner/divider. Only a combiner is however described referring to the drawings since a divider and a combiner are identical to each other regarding the structure but opposite to each other regarding the operation.

Figure 2:
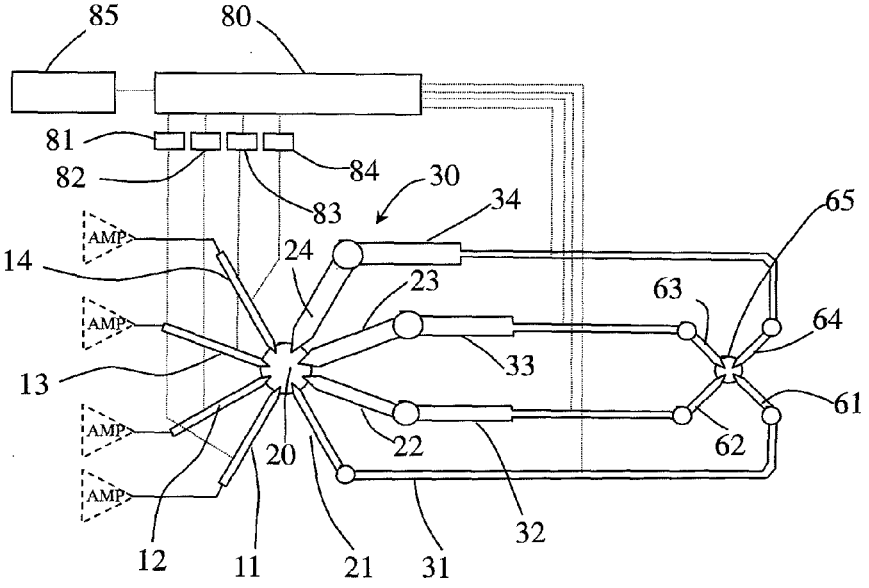
FIG. 2 is a block diagram of a control circuit connected to the RF combiner/divider shown in FIG. 1.

Referring to FIGS. 1 and 2, an RF combiner includes an input switch 10, an output switch 60, an impedance-matching transmission network 30 and a control circuit 80 according to an embodiment of the present invention. The impedance-matching transmission network 30 connects the input switch 10 to the output switch 60 electrically. The control circuit 80 is electrically connected to the input switch 10 and the impedance matching transmission network 30.

The input switch 10 is preferably a single-poled 2N-throw RF switch such as a single-poled 8-throw ("SP8T") switch. Half of the stationary contacts of the single-poled 2N-throw RF switch are used as input channels 11, 12, 13 and 14 of the input switch 10. The other stationary contacts of the single-poled 2N-throw RF switch are used as switching elements 21, 22, 23 and 24 of the impedance-matching transmission network 30. The input channels 11, 12, 13 and 14 and the switching elements 21, 22, 23 and 24 are connected to a center connection point 20 under the control of the control circuit 80.

Each of the input channels 11, 12, 13 and 14 of the input switch 10 receives an input signal. Thus, there is characteristic impedance $Z_0$ at each of the input channels 11, 12, 13 and 14. The input signals include but not limited to RF signals, microwave frequency signals and signals at higher frequencies.

There is respective transformation impedance at each of the switching elements 21, 22, 23 and 24 as part of the impedance-matching transmission network 30. To this end, each of the switching elements 21, 22, 23 and 24 is sized according to the respective transformation impedance. The size includes length and/or cross-sectional width.

The output switch 60 is preferably a high-power single-pole N-throw switch such as single-pole 4-throw ("SP4T") switch. The single-pole N-throw switch includes four input channels 61, 62, 63 and 64 which are all connected to an output port 65 electrically. The input channels 61, 62, 63 and 64 are connected to the switching elements 21, 22, 23 and 24 via impedance transmission lines 31, 32, 33 and 34, respectively. Hence, impedance at each of the input channels 61, 62, 63 and 64 is identical to the impedance at a corresponding one of the input channels 11, 12, 13 and 14 of the input switch 10.

The impedance-matching transmission network 30 includes the switching elements 21, 22, 23 and 24 and the impedance transmission lines 31, 32, 33 and 34 for connecting the switching elements 21, 22, 23 and 24 to the input channels 61, 62, 63 and 64. The impedance transmission lines 31, 32, 33 and 34 are impedance-controlled RF transmission lines including but not limited to coaxial cables, coaxial structures built therein, circuit board transmission lines and microstriplines.

The on/off of the input channels 11, 12, 13 and 14 of the input switch 10 are under the control of the control circuit 80 based on digital inputs 81, 82, 83 and 84 thereat. The digital input at each of the digital inputs 81, 82, 83 and 84 may be "1" to represent the turning on of a corresponding one of the input channels 11, 12, 13 and 14. The digital input at each of the digital inputs 81, 82, 83 and 84 may alternatively be "0" to represent the turning off of a corresponding one of the input channels 11, 12, 13 and 14.

A selector 85 is connected to the control circuit 80 and operable to select a number of the input channels 11, 12, 13 and 14 to be turned on. Based on the selected number, the control circuit 80 turns on at least some of the input channels 11, 12, 13, 14 and connects the input switch 10 to the output switch 60 via a selected one of the impedance transformers 35, 36, 37 and 38 of the impedance-matching transmission network 30 for impedance transformation in an impedance-matched manner.

For example, three of the input channels of the input switch 10 may be turned on. The characteristic impedance $Z_0$ at each turned-on input channel is 50 Ω ($Z_0$=50 Ω). The total impedance at the center connection point 20 is $Z_0/N$ (50 Ω/3=16.66 Ω). By using the impedance-matching transmission network 30 for impedance transformation, the output impedance at the output switch 60 is matched with the characteristic impedance $Z_0$, i.e., $Z_0/N$ is transformed to $Z_0$ for output.

For example, only one of the input channels of the input switch 10 is turned on. The control circuit 80 connects the input switch 10 to the output switch 60 via the impedance transformer 35 where the impedance is $Z_0/\sqrt{1}$.

For example, two of the input channels of the input switch 10 are turned on. The control circuit 80 connects the input switch 10 to the output switch 60 via the impedance transformer 36 where the impedance is $Z_0/\sqrt{2}$.

For example, three of the input channels of the input switch 10 are turned on. The control circuit 80 connects the input switch 10 to the output switch 60 via the impedance transformer 37 where the impedance is $Z_0/\sqrt{3}$.

For example, four of the input channels of the input switch 10 are turned on. The control circuit 80 connects the input switch 10 to the output switch 60 via the impedance transformer 38 where the impedance is $Z_0/\sqrt{4}$.

Figure 3:
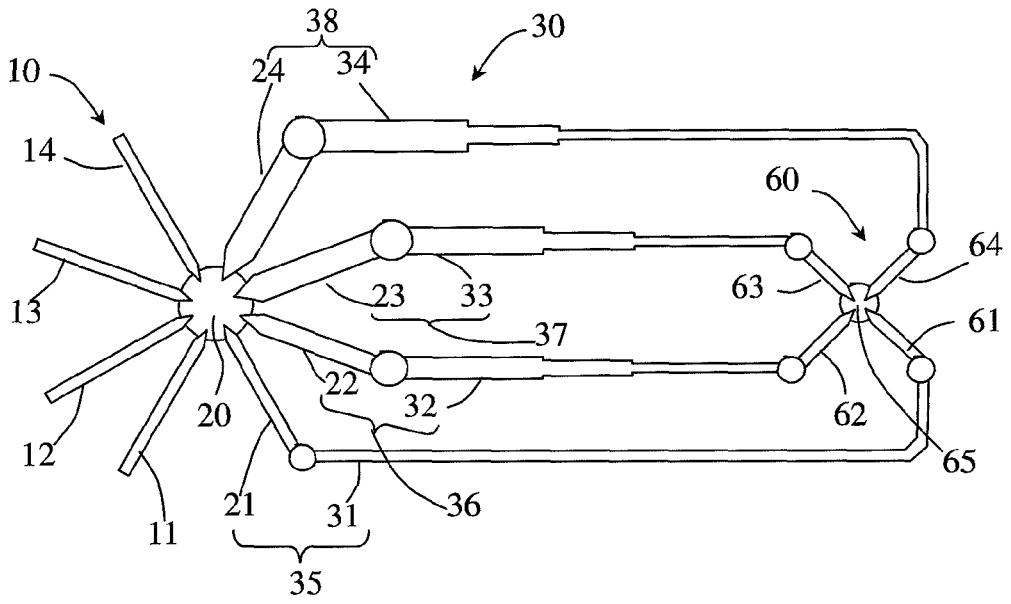
FIG. 3 is a block diagram of an RF combiner/divider according to the second embodiment of the present invention, showing that an impedance transformer includes a multiple-stage quarter-wavelength transmission line.

Referring to FIG. 3, to satisfy the need for a larger bandwidth, the impedance transformers 35, 36, 37 and 38 may include multiple-stage quarter-wavelength transformation lines 31, 32, 33 and 34 according to another embodiment of the present invention.

Each of the switching elements 21, 22, 23 and 24 is connected to a corresponding one of the impedance transmission lines 31, 32, 33 and 34 to form a corresponding one of the quarter-wavelength impedance transformers 35, 36, 37 and 38 as in the embodiment shown in FIG. 1. The electrical length of the impedance-matching transmission network 30, a quarter of the wavelength, is longer than the electrical length of each of the switching elements 21, 22, 23 and 24, and terminates prior to the input channels 61, 62, 63 and 64 of the output switch 60. Hence, the impedance at initial ends of the impedance transmission lines 31, 32, 33 and 34 are $Z_0/\sqrt{1}$, $Z_0/\sqrt{2}$, $Z_0/\sqrt{3}$ and $Z_0/\sqrt{4}$, respectively. The impedance is increased to $Z_0$ at a certain point where the electrical length of each of the switching elements 21, 22, 23 and 24 is subtracted from the electrical length of a quarter of the wavelength. Hence, the impedance at each of the input channels 61, 62, 63 and 64 of the output switch 60 is $Z_0$.

Figure 4:
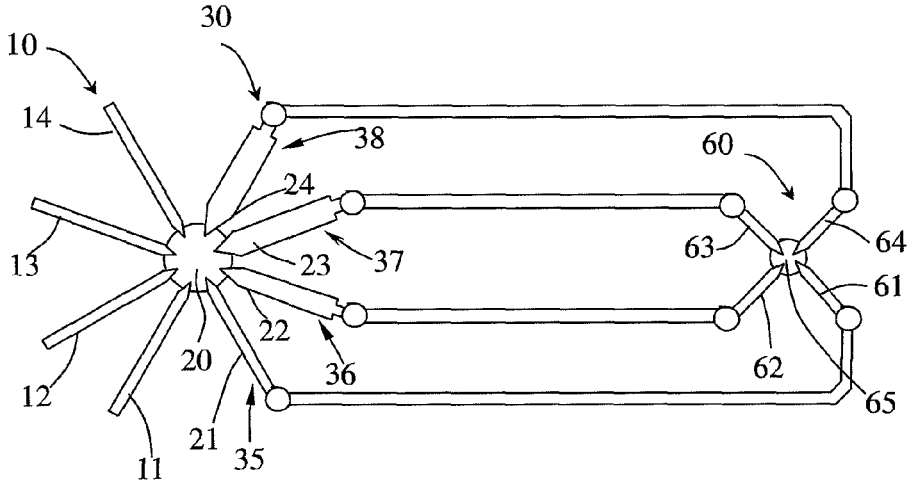
FIG. 4 is a block diagram of an RF combiner/divider according to the third embodiment of the present invention, showing that a quarter of a wavelength of an impedance matching transmission network is shorter than the electrical length of the switching elements.

Each of the impedance-switching elements 21, 22, 23 and 24 forms a corresponding one of the quarter-wavelength impedance transformers 35, 36, 37 and 38 according to another embodiment of the present invention referring to FIG. 4. The electrical length of the impedance-matching transmission network 30, a quarter of the wavelength, is shorter than the electrical length of each of the switching elements 21, 22, 23 and 24. The impedance-matching transmission network 30 is connected to the switching elements 21, 22, 23 and 24 via changing the size. Hence, the impedance at the entire impedance-matching transmission network 30 and the impedance at the output switch 60 are $Z_0$.

Figure 5:
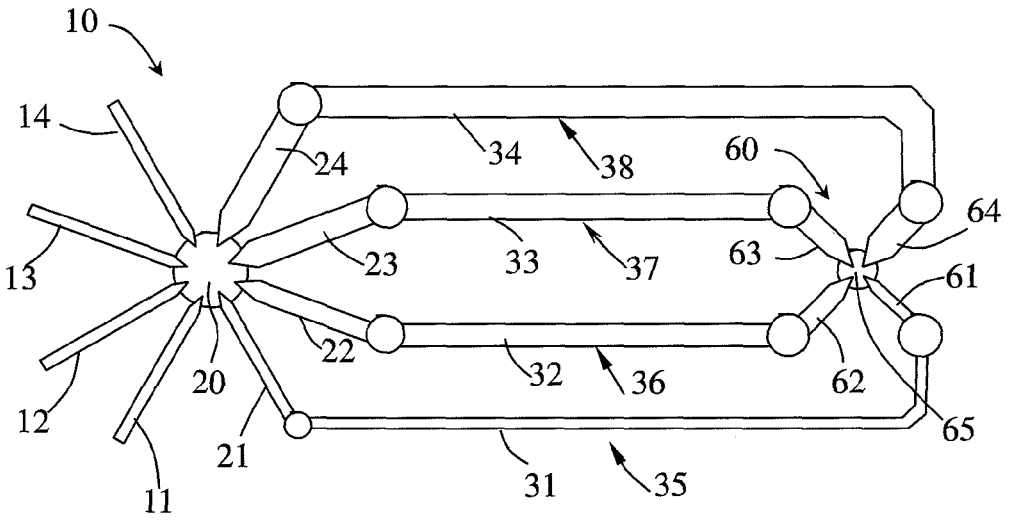
FIG. 5 is a block diagram of an RF combiner/divider according to the fourth embodiment of the present invention, showing that an electrical length measured from a center connection point of an input switch to an output port of an output switch is identical to a quarter of a wavelength.

Each of the switching elements 21, 22, 23 and 24, a corresponding one of the impedance transmission lines 31, 32, 33 and 34 and a corresponding one of the input channels 61, 62, 63 and 64 are interconnected serially to form a corresponding one of the quarter-wavelength impedance transformers 35, 36, 37 and 38 according to another embodiment of the present invention referring to FIG. 5. The total electrical length measured from the center connection point 20 of the input switch 10 to the output port 65 is identical to a quarter of the wavelength. That is, the total electrical length that is formed by interconnecting the switching elements 21, 22, 23 and 24, the impedance transmission lines 31, 32, 33 and 34 and the input channels 61, 62, 63 and 64 is identical to a quarter of the wavelength. Hence, the impedance at the channel that consists of the switching element 21, the impedance transmission line 31 and the input channel 61 is $Z_0/$. The impedance at the channel that consists of the switching element 22, the impedance transmission line 32 and the input channel 62 is $Z_0/\sqrt{2}$. The impedance at the channel that consists of the switching element 23, the impedance transmission line 33 and the input channel 63 is $Z_0/\sqrt{3}$. The impedance at the channel that consists of the switching element 24, the impedance transmission line 34 and the input channel 64 is $Z_0/\sqrt{4}$.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. An RF combiner/divider including:

an input switch including input channels for receiving input signals, wherein the input switch is a single-pole 2N-throw RF switch formed with stationary contacts, and half of the stationary contacts are used as the input channels;

an output switch including an output port and input channels electrically connected to the output port, wherein the total amount of the input channels of the output switch is identical to that of the input channels of the input switch;

an impedance-matching transmission network including switching elements and impedance transmission lines for electrically connecting the switching elements to the input channels of the output switch, wherein the total amount of the switching elements is identical to that of the input channels of the input switch, wherein the other stationary contacts are used as the switching elements; and a control circuit for controlling a number of the input channels of the input switch for connection to a center connection point and selectively connecting an impedance-matched one of the switching elements to the center connection point.

2. The RF combiner/divider according to claim 1, wherein each of the switching elements is connected to a corresponding one of the impedance transmission lines to thrill a quarter-wavelength impedance transformer.

3. The RF combiner/divider according to claim 1, wherein each of the switching elements forms a quarter-wavelength impedance transformer.

4. The RF combiner/divider according to claim 1, wherein each of the switching elements, a corresponding one of the impedance transmission lines and a corresponding one of the input channels of the output switch are interconnected to form a quarter-wavelength impedance transformer.

5. The RF combiner/divider according to claim 1, wherein the impedance transmission lines of the impedance-matching transmission network are quarter-wavelength transmission lines.

6. The RF combiner/divider according to claim 1, wherein the impedance transmission lines of the impedance-matching transmission network are multiple-stage quarter-wavelength transmission lines.

7. The RF combiner/divider according to claim 1, wherein the control circuit controls the on/off of each of the input channels of the input switch via a digital input thereat.

8. The RF combiner/divider according to claim 7, wherein the digital input is switched between a value, "1", to represent the turning on of the corresponding input channel and another value, "0", to represent the turning off of the corresponding input channel.

9. The RF combiner/divider according to claim 7, further including a selector connected to the control circuit and operable to select a number of the input channels to be turned on.

10. The RF combiner/divider according to claim 1, wherein the electrical length of the impedance-matching transmission network is a quarter of the wavelength and identical to that of the switching elements.

11. The RF combiner/divider according to claim 1, wherein the electrical length of the impedance-matching transmission network is a quarter of the wavelength and shorter than that of the switching elements.

12. The RF combiner/divider according to claim 1, wherein the total electrical length measured from a center connection point of the input switch to the output port of the output switch is identical to a quarter of the wavelength.

* * * * *